US010731494B2

(12) United States Patent
Dev et al.

(10) Patent No.: US 10,731,494 B2
(45) Date of Patent: Aug. 4, 2020

(54) OVERHANGING SEAL ASSEMBLY FOR A GAS TURBINE

(71) Applicant: General Electric Company, Schenectady, NY (US)

(72) Inventors: Bodhayan Dev, Niskayuna, NY (US); Neelesh Nandkumar Sarawate, Niskayuna, NY (US); Matthew Troy Hafner, Honea Path, SC (US)

(73) Assignee: General Electric Company, Schenectady, NY (US)

( * ) Notice: Subject to any disclaimer, the term of this patent is extended or adjusted under 35 U.S.C. 154(b) by 801 days.

(21) Appl. No.: 15/298,572

(22) Filed: Oct. 20, 2016

(65) Prior Publication Data

US 2018/0112549 A1 Apr. 26, 2018

(51) Int. Cl.
*F01D 11/00* (2006.01)
*F01D 9/04* (2006.01)

(52) U.S. Cl.
CPC ..... *F01D 11/005* (2013.01); *F01D 9/041* (2013.01); *F05D 2220/32* (2013.01); *F05D 2300/10* (2013.01); *F05D 2300/6033* (2013.01)

(58) Field of Classification Search
CPC ..... F01D 11/005
See application file for complete search history.

(56) References Cited

U.S. PATENT DOCUMENTS 3,527,053 A 9/1970 Horn
5,088,888 A 2/1992 Bobo
5,154,577 A 10/1992 Kellock et al.
5,868,398 A 2/1999 Maier et al.
8,075,255 B2 12/2011 Morgan
8,858,166 B2 10/2014 Zheng et al.
8,998,573 B2 * 4/2015 Albers ..... F01D 11/005 415/173.3

(Continued)

OTHER PUBLICATIONS

H L Stocker, "Advanced Labyrinth Seal Design Performance for High Pressure Ratio Gas Turbines", ASME 1975 Winter Annual Meeting: GT Papers, pp. V001T01A005, 1975.

(Continued)

*Primary Examiner* — Igor Kershteyn
*Assistant Examiner* — John S Hunter, Jr.
(74) *Attorney, Agent, or Firm* — Ann Agosti

(57) ABSTRACT

Various embodiments include gas turbine seals and methods of forming such seals for advanced gas path (AGP) heat transfer designed gas turbine engines. In some cases, a turbine includes: a first arcuate component adjacent to a second arcuate component, each arcuate component formed of a ceramic matrix composite and including a seal slot located in an end face, each seal slot having a plurality of axial surfaces and radially facing surfaces extending from opposite ends of the axial surfaces and an overhanging seal assembly disposed in the seal slot. The overhanging seal assembly including an intersegment seal including a plurality of seal segments defining two vertical seal segments and a plurality of horizontal seal segments and a first overhanging positioner shim seal and a second overhanging positioner shim seal, each including an extended portion. The overhanging seal assembly disposed in the seal slot so as to provide position constrainment of the two vertical seal segments.

19 Claims, 6 Drawing Sheets

(56) References Cited

U.S. PATENT DOCUMENTS

| | | | | |
|---|---|---|---|---|
| 9,115,810 | B2 | 8/2015 | Bidkar et al. | |
| 2012/0119449 | A1 | 5/2012 | Demiroglu et al. | |
| 2014/0348642 | A1* | 11/2014 | Weber | F01D 11/005 415/170.1 |

OTHER PUBLICATIONS

Zhe et al., "Using Advanced Steam Seal Technology to Improve Steam Turbines Efficiency", Thermal Turbine, Issue: 01, 2009.

* cited by examiner

OVERHANGING SEAL ASSEMBLY FOR A GAS TURBINE

BACKGROUND

The subject matter disclosed herein relates to turbines. Specifically, the subject matter disclosed herein relates to seals in gas turbines.

The main gas-flow path in a gas turbine commonly includes the operational components of a compressor inlet, a compressor, a turbine and a gas outflow. There are also secondary flows that are used to cool the various heated components of the turbine. Mixing of these flows and gas leakage in general, from or into the gas-flow path, is detrimental to turbine performance.

The operational components of a gas turbine are contained in a casing. The turbine is commonly surrounded annularly by adjacent arcuate components. As used herein, the term "arcuate" may refer to a member, component, part, etc. having a curved or partially curved shape. The adjacent arcuate components include outer shrouds, inner shrouds, nozzle blocks, and diaphragms. The arcuate components may provide a container for the gas-flow path in addition to the casing alone. The arcuate components may secure other components of the turbine and may define spaces within the turbine.

Between each adjacent pair of arcuate components is a space or gap that permits the arcuate components to expand as the operation of the gas turbine forces the arcuate components to expand. Typically, one or more seal slots are defined on the end faces of each arcuate component for receiving a seal assembly in cooperation with an adjacent seal slot of an adjacent arcuate component. The seal assembly is placed in the seal slot to prevent leakage between the areas of the turbine on either side of the seal assembly. The conventional static seals used are either separate laminate or solid seals.

In some embodiments, the seal slot may include multiple seal slots within the end of a particular arcuate component that connect one to another. Furthermore, multiple seal slots within the end of a particular arcuate component may be angled in orientation to each other. Typically a planar seal is received in each of the seal slots that are connected. Each of the planar seals has ends, with the seals being positioned in each of the two seal slots in an end-to-end orientation.

In advanced gas path (AGP) heat transfer design for gas turbine engines, the arcuate components, and in particular the shrouds, are fabricated with ceramic matrix composites (CMCs). The static seals in the AGP shrouds are made of a high temperature nickel alloy. As the CMC shrouds have lower co-efficient of thermal expansion (CTE) compared to the static seals, the seals have to be designed shorter to account for the CTE mismatch. Typically, a plurality of vertical solid laminate/solid seals are designed shorter and are susceptible to shifting downward within the seal slot and a bottom horizontal seal while under-going thermal expansion would eventually crush the vertical seals.

Accordingly, it would be desirable to reduce or substantially eliminate leakage between AGP turbomachinery components formed of ceramic matrix composites, such as between adjacent shrouds, by utilizing seals. It is further desirable that such seals are designed to account for CTE mismatch between the AGP components and the seal, while being substantially temperature resistant and wear resistant (i.e., long component life), sufficiently flexible so as to provide adequate sealing during use and any misalignment, and meet the manufacturing, assembly, installation and robustness requirements associated with turbomachinery.

BRIEF DESCRIPTION

Various embodiments of the disclosure include gas turbine seal assemblies for use with AGP turbomachinery components and methods of forming such seals. In accordance with one exemplary embodiment, disclosed is an overhanging seal assembly to seal a gas turbine hot gas path flow in a gas turbine. The overhanging seal assembly includes an overhanging seal assembly to seal a gas turbine hot gas path flow in a gas turbine. The overhanging seal assembly includes an intersegment seal and a first overhanging positioner shim seal and a second overhanging positioner shim seal. The intersegment seal includes a plurality of seal segments defining two vertical seal segments and a plurality of horizontal seal segments. The intersegment seal is disposed in a seal slot. Each of the first overhanging positioner shim seal and the second overhanging positioner shim seal includes an extended portion. The first and second overhanging positioner shim seals disposed in the seal slot on an exterior side of the seal slot and adjacent the two vertical seal segments and at least portion of the horizontal seal segments. The extended portions of the overhanging seal segments are disposed in the seal slot on an interior side of the seal slot and adjacent one of the plurality of horizontal seal segments so as to provide position constrainment of the two vertical seal segments.

In accordance with another exemplary embodiment, disclosed is a gas turbine. The gas turbine includes a gas turbine. The gas turbine includes a first arcuate component adjacent to a second arcuate component and an overhanging seal assembly. The first arcuate component is adjacent to a second arcuate component. Each of the arcuate components is comprised of a ceramic matrix composite (CMC) and includes a seal slot defined by one or more seal slot segments, located in an end face. The seal slot has a plurality of substantially axial surfaces and one or more radially facing surfaces extending from opposite ends of the substantially axial surfaces. The overhanging seal assembly is disposed in the seal slot of the first arcuate component and the seal slot of the second arcuate component. The overhanging seal assembly includes an intersegment seal and a first overhanging positioner shim seal and a second overhanging positioner shim seal. The intersegment seal includes a plurality of seal segments defining two vertical seal segments and a plurality of horizontal seal segments. Each of the first overhanging positioner shim seal and the second overhanging positioner shim seal include an extended portion. The first overhanging positioner shim seal is disposed in the seal slot on an exterior side and adjacent one of the two vertical seal segments and at least portion of the horizontal seal segments. The second overhanging positioner shim seal is disposed in the seal slot on an exterior side and adjacent the other one of the two vertical seal segments and at least portion of another one of the horizontal seal segments. The extended portions of each of the first and second overhanging seal segments are disposed in the seal slot on an interior side of the seal slot and adjacent another one of the plurality of horizontal seal segments and in a manner to provide position constrainment of the two vertical seal segments.

In accordance with yet another exemplary embodiment, disclosed is a method of assembling a seal in a turbine. The method includes forming an overhanging seal assembly. The step of forming includes providing an intersegment seal including a plurality of seal segments defining two vertical seal segments and a plurality of horizontal seal segments. The step of forming further includes providing a first overhanging positioner shim seal and a second overhanging positioner shim seal. Each of the overhanging positioner shim seals includes an extended portion. The method further includes applying the overhanging seal assembly to the turbine. The turbine includes a first arcuate component adjacent to a second arcuate component. Each of the arcuate components including a seal slot located in an end face and having a plurality of axial surfaces and radially facing surfaces extending from opposite ends of the axial surfaces. The step of applying the overhanging seal assembly to the turbine further includes, inserting the overhanging seal assembly in the seal slot of the first arcuate component and the second arcuate component such that the intersegment seal is disposed in the seal slot on each arcuate component and extending over the axial surfaces and the radially facing surfaces of the seal slots. The first overhanging positioner shim seal and a second overhanging positioner shim seal are disposed in the seal slots relative to the plurality of horizontal intersegment seals to provide position constrainment of the two vertical seal segments.

Other objects and advantages of the present disclosure will become apparent upon reading the following detailed description and the appended claims with reference to the accompanying drawings. These and other features and improvements of the present application will become apparent to one of ordinary skill in the art upon review of the following detailed description when taken in conjunction with the several drawings and the appended claims.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

Figure 1:
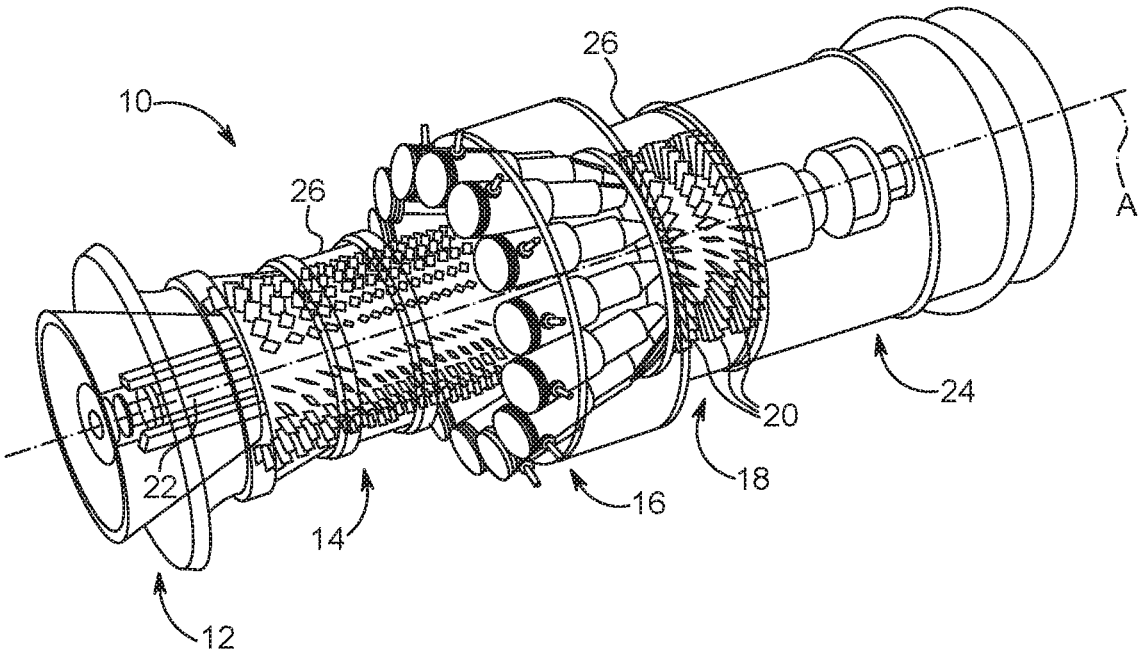
FIG. 1 PRIOR ART
FIG. 1 shows a perspective partial cut-away view of a known gas turbine.

It is noted that the drawings as presented herein are not necessarily to scale. The drawings are intended to depict only typical aspects of the disclosed embodiments, and therefore should not be considered as limiting the scope of the disclosure. In the drawings, like numbering represents like elements between the drawings.

DETAILED DESCRIPTION

As noted herein, the subject matter disclosed relates to turbines. Specifically, the subject matter disclosed herein relates to cooling fluid flow in gas turbines and the sealing within such turbines. In contrast to conventional approaches, the disclosed embodiment of the disclosure includes gas turbomachine (or, turbine) static hot gas path components that utilize advanced gas path (AGP) heat transfer design, and are thus formed of ceramic matric composites (CMCs). Such static hot gas path components as described herein may include nozzles and shrouds.

As denoted in these Figures, the "A" axis (FIG. 1) represents axial orientation (along the axis of the turbine rotor). As used herein, the terms "axial" and/or "axially" refer to the relative position/direction of objects along the axis A, which is substantially parallel with the axis of rotation of the turbomachine (in particular, the rotor section). As further used herein, the terms "radial" and/or "radially" refer to the relative position/direction of objects along an axis (not shown), which is substantially perpendicular with axis A and intersects axis A at only one location. Additionally, the terms "circumferential" and/or "circumferentially" refer to the relative position/direction of objects along a circumference (not shown), which surrounds axis A but does not intersect the axis A at any location. It is further understood that common numbering between the various Figures denotes substantially identical components in the Figures.

Referring to FIG. 1, a perspective view of one embodiment of a gas turbine 10 is shown. In this embodiment, the gas turbine 10 includes a compressor inlet 12, a compressor 14, a plurality of combustors 16, a compressor discharge (not shown), a turbine 18 including a plurality of turbine blades 20, a rotor 22 and a gas outflow 24. The compressor inlet 12 supplies air to the compressor 14. The compressor 14 supplies compressed air to the plurality of combustors 16 where it mixes with fuel. Combustion gases from the plurality of combustors 16 propel the turbine blades 20. The propelled turbine blades 20 rotate the rotor 22. A casing 26 forms an outer enclosure that encloses the compressor inlet 14, the compressor 14, the plurality of combustors 16, the compressor discharge (not shown), the turbine 18, the turbine blades 20, the rotor 22 and the gas outflow 24. The gas turbine 10 is only illustrative; teachings of the disclosure may be applied to a variety of gas turbines.

Figure 2:
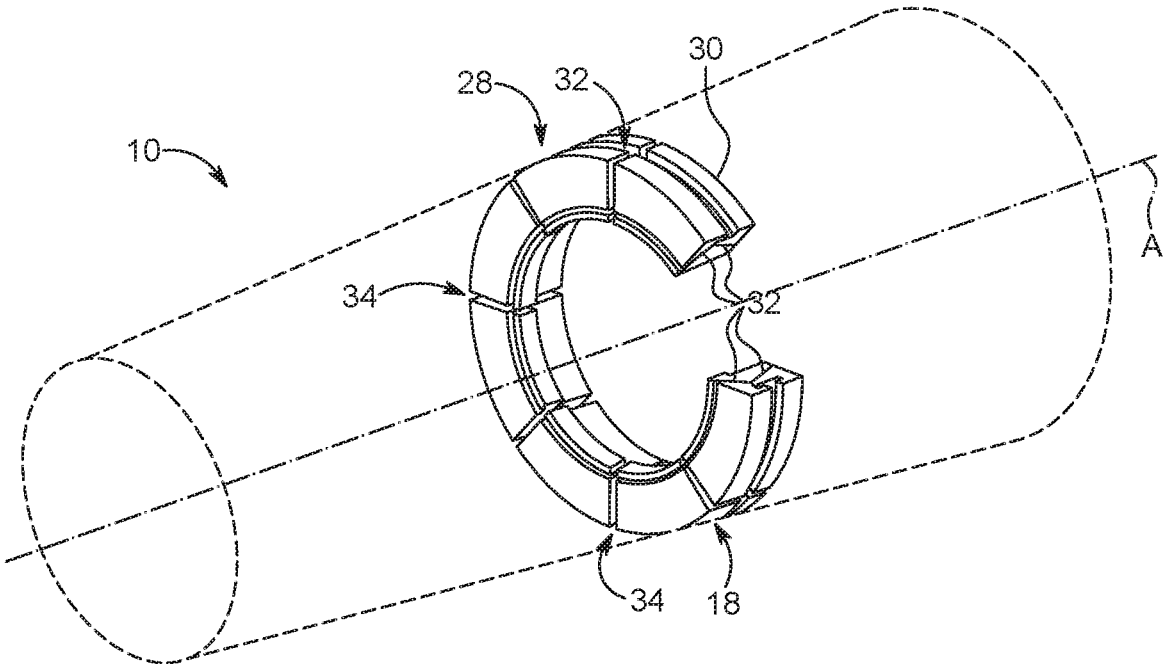
FIG. 2 PRIOR ART
FIG. 2 shows a perspective view of known arcuate components in an annular arrangement.

In an embodiment, stationary components of each stage of a hot gas path (HGP) of the gas turbine 10 consists of a set of nozzles (stator airfoils) and a set of shrouds (the static outer boundary of the HGP at the rotor airfoils 20). Each set of nozzles and shrouds are comprised of numerous arcuate components arranged around the circumference of the hot gas path. Referring more specifically to FIG. 2, a perspective view of one embodiment of an annular arrangement 28 including a plurality of arcuate components 30 of the turbine 18 of the gas turbine 10 is shown. In the illustrated embodiment, the annular arrangement 28 as illustrated includes seven arcuate components 30, with one arcuate component removed for illustrative purposes. Between each of the arcuate components 30 is an inter-segment gap 34. This segmented construction is necessary to manage thermal distortion and structural loads and to facilitate manufacturing and assembly of the hardware.

A person skilled in the art will readily recognize that annular arrangement 28 may have any number of arcuate components 30; that the plurality of arcuate components 30 may be of varying shapes and sizes; and that the plurality of arcuate components 30 may serve different functions in gas turbine 10. For example, arcuate components in a turbine may include, but not be limited to, outer shrouds, inner shrouds, nozzle blocks, and diaphragms as discussed below.

Figure 3:
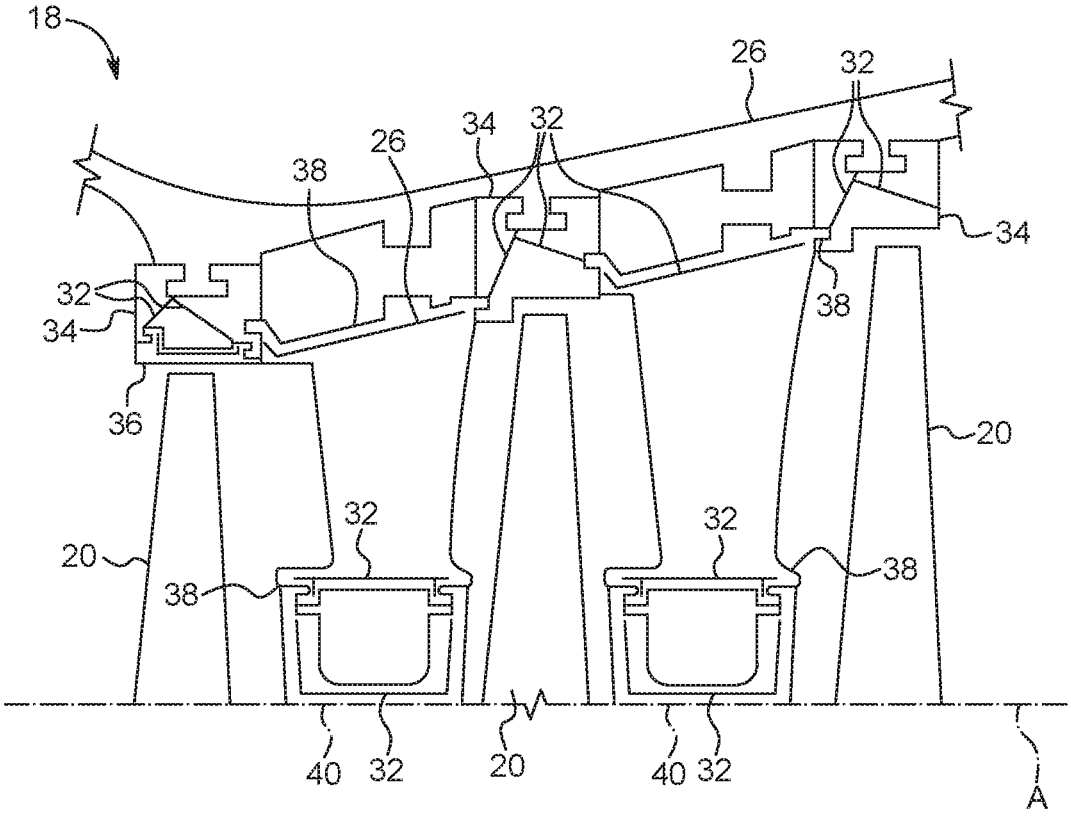
FIG. 3 PRIOR ART
FIG. 3 shows a cross-sectional longitudinal view of a portion of a known turbine of a gas turbine.

Referring to FIG. 3, a cross-sectional view of a known embodiment of turbine 18 of gas turbine 10 (FIG. 1) is shown. In this embodiment, the casing 26 encloses a plurality of outer shrouds 34, an inner shroud 36, a plurality of nozzle blocks 38, a plurality of diaphragms 40, and turbine blades 20. Each of the outer shrouds 34, inner shroud 36, nozzle blocks 38 and diaphragms 40 form a part of the arcuate components 30. Each of the outer shrouds 34, inner shrouds 36, nozzle blocks 38 and diaphragms 40 have one or more seal slots 32 in a side thereof. In this embodiment, the plurality of outer shrouds 34 connect to the casing 26; the inner shroud 36 connects to the plurality of outer shrouds 34; the plurality of nozzle blocks 38 connect to the plurality of outer shrouds 34; and the plurality of diaphragms 40 connect to the plurality of nozzle blocks 38. A person skilled in the art will readily recognize that many different arrangements and geometries of arcuate components are possible. Alternative embodiments may include different arcuate component geometries, more arcuate components, or less arcuate components.

Cooling air is typically used to actively cool and/or purge the static hot gas path (bled from the compressor of the gas turbine engine 10) leaks through the inter-segment gaps 34 for each set of nozzles and shrouds. This leakage has a negative effect on overall engine performance and efficiency because it is parasitic to the thermodynamic cycle and it has little if any benefit to the cooling design of the hot HGP component. As previously indicated, seals are typically incorporated into the inter-segment gaps 34 of static HGP components to reduce leakage. The one or more seal slots 32 provide for placement of such seals at the end of each arcuate component 30.

These inter-segment seals are typically straight, rectangular solid pieces of various types of construction (e.g. solid, laminate, shaped, such as "dog-bone"). The seals serve to seal the long straight lengths of the seal slots 32 fairly well, but they do not seal at the corners where adjacent seal slots intersect nor do they account for the CTE mismatch of advanced gas path (AGP) heat transfer designed components and the seals. It is a significant benefit to engine performance and efficiency to maintain positioning of the seals while sealing these corner leaks more effectively. This is a challenging engine design detail because of numerous design constraints including the tight spaces in the inter-segment gaps 34 and seal slots 32, the need for relatively easy assembly and disassembly, thermal movement during engine operation, and the complicated route of leakage at the corner leaks.

As previously indicated, in advanced gas path (AGP) heat transfer designs for gas turbine engines, the arcuate components, and in particular the shrouds, are fabricated with ceramic matrix composites (CMCs). Similar to seal assemblies used in conventional designs, the AGP shrouds utilize static seals that are typically straight, rectangular solid pieces of various types of construction (e.g. solid, laminate, shaped, such as "dog-bone"). The static seals in the AGP shrouds are made of a high temperature metal material, such as nickel alloy. The CMC material that forms the AGP shrouds has a lower co-efficient of thermal expansion (CTE) compared to the static seals formed of the high temperature metal. Accordingly, the static seals have to be designed shorter to account for the CTE mismatch and are susceptible to shifting downward within the seal slot. In addition, a bottom horizontal seal, while under-going thermal expansion, would eventually crush the vertical seals. Accordingly, by designing the seal assembly to include an overhanging shim as described herein, the CTE mismatch can be addressed.

Figure 4:
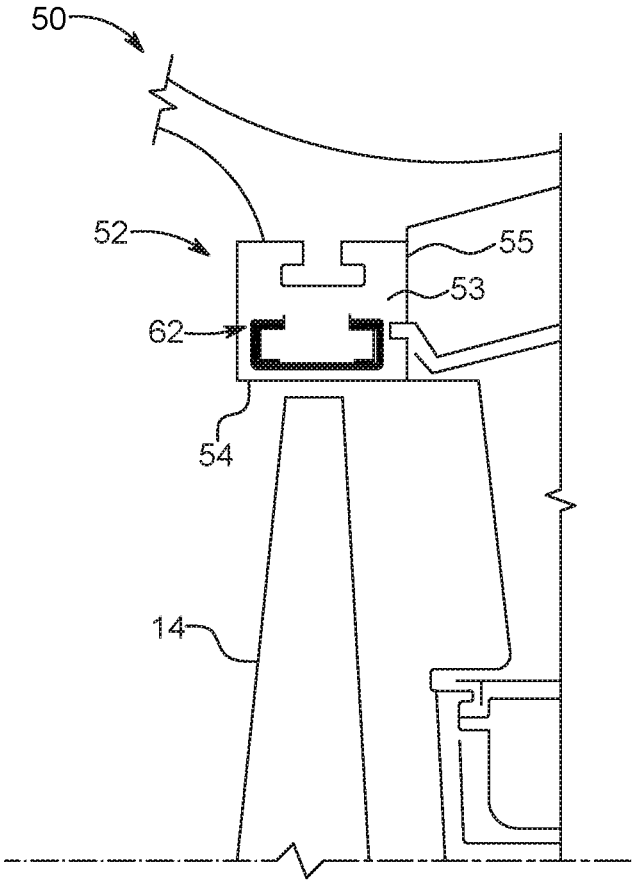
FIG. 4 shows a cross-sectional end view of one embodiment of an arcuate component with an overhanging seal assembly disposed in connected seal slots, in accordance with one or more embodiments shown or described herein.
Figure 5:
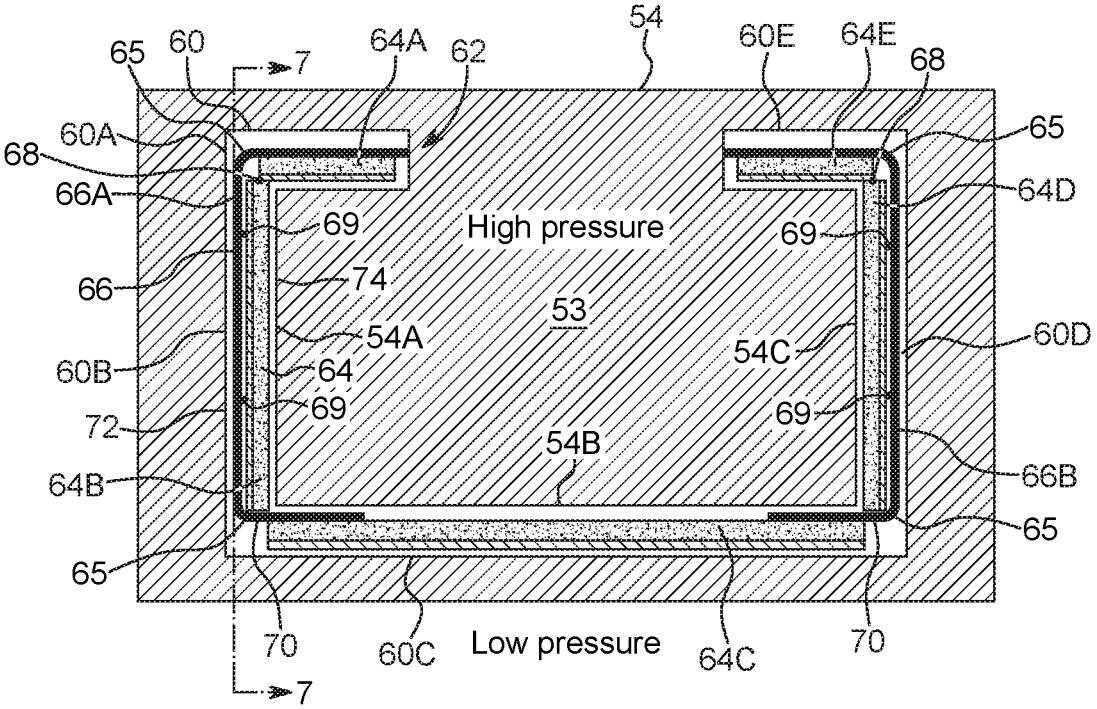
FIG. 5 shows an enlarged cross-sectional view of the overhanging seal assembly of FIG. 4, in accordance with one or more embodiments shown or described herein.
Figure 6:
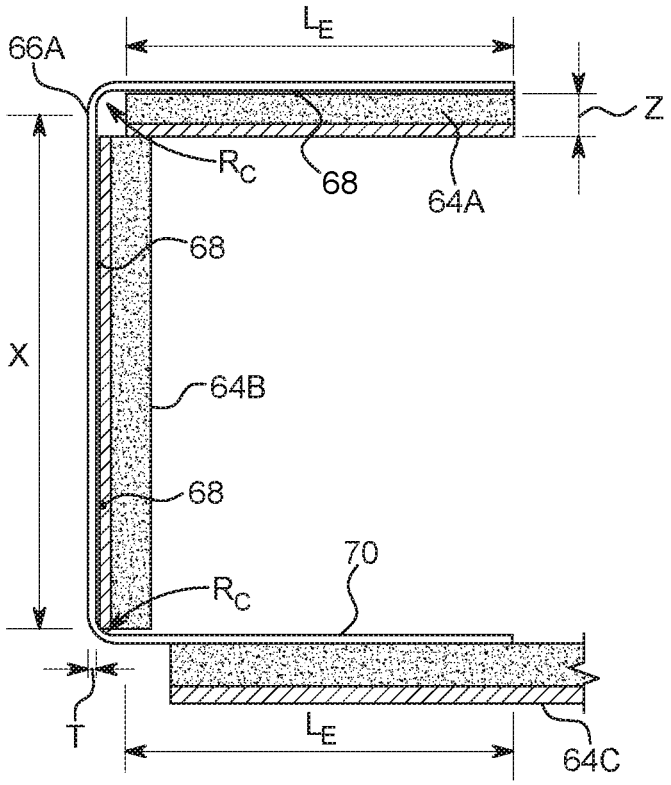
FIG. 6 shows an enlarged cross-sectional view of a portion of the overhanging seal assembly of FIG. 5, in accordance with one or more embodiments shown or described herein.
Figure 7:
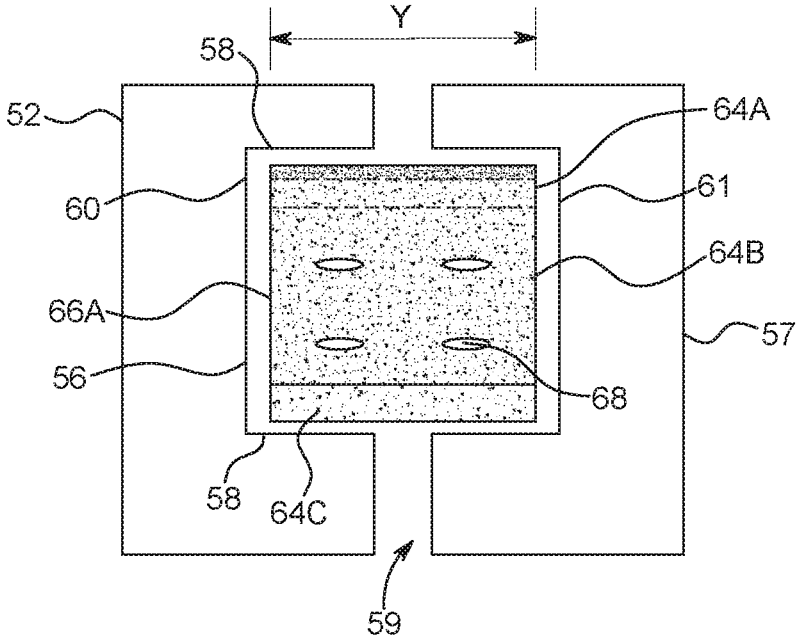
FIG. 7 shows a cross-sectional view of the overhanging seal assembly of FIG. 5, taken through line 7-7 of FIG. 5, in relation to a first arcuate component and a second arcuate component, in accordance with one or more embodiments shown or described herein.
Figure 8:
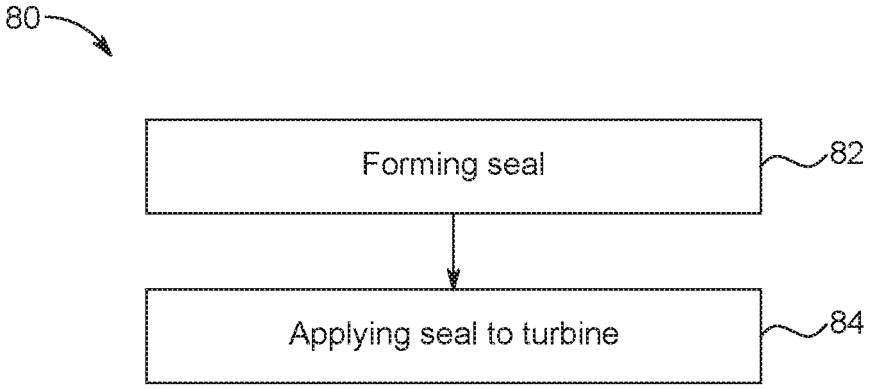
FIG. 8 is a flow diagram illustrating a method, in accordance with one or more embodiments shown or described herein.

Turning to FIGS. 4-7, illustrated are schematic views of an overhanging seal assembly for use in a turbine that utilizes advanced gas path (AGP) heat transfer designs, as disclosed herein. More particularly, illustrated in FIG. 4 is a cross-sectional longitudinal view of a portion of a turbine 50, generally similar to gas turbine 10 of FIGS. 1-3, except in this particular embodiment the turbine utilizes advanced gas path (AGP) heat transfer design. FIG. 4 shows an end view of an exemplary first arcuate component 52 including a shroud 54 and an overhanging seal assembly 62, described presently. FIG. 5 shows an enlargement of a portion of the shroud 54, including the overhanging seal assembly 62 disposed therein. FIG. 6 shows a further enlargement of a portion of the overhanging seal assembly 62 as disclosed herein. FIG. 7 shows a cross sectional axial view taken along line 7-7 in FIG. 6 of the first arcuate component 52 and a second arcuate component 57, in spaced relation to one another, and having an overhanging seal assembly 62 disposed therebetween.

Referring more particularly to FIGS. 4 and 5, turbine 50 includes the first arcuate component 52 having formed as a portion thereof, a shroud 54 formed of a CMC material 55. The shroud 54 includes a seal slot 60 formed in an end face 53. The seal slot 60 may be comprised of multiple slot portions 60A, 60B, 60C, 60D, 60E, shown formed at an angle in relation to each other and connected and/or positioned relative to one another. The seal slot 60 may be comprised of any number of intersecting or connected slot portions.

In the illustrated embodiment of FIGS. 4-7, the gas turbine 50 includes the overhanging seal assembly 62 disposed in the seal slot 60, wherein the overhanging seal assembly 62 contacts an adjacent cooperating slot formed in an end face of an adjacent second arcuate component (described presently) at their axial surfaces, and extends over their radially facing surfaces. It should be understood that the description of the overhanging seal assembly 62 will be described below in relation to slot 60 formed in the shroud 54 of the first arcuate component 52, but is similarly applicable to a seal slot formed in an arcuate component, such as arcuate component 30, of FIG. 2, upon disposing therein adjacent slots.

Referring again to FIG. 5, the overhanging seal assembly 62 includes an intersegment seal 64 disposed into the seal slot 60. More particularly, the intersegment seal 64 includes a first horizontal seal segment 64A disposed into the horizontal slot segment 60A, a first vertical seal segment 64B disposed into the vertical slot segment 60B, a second horizontal seal segment 64C disposed into the horizontal slot segment 60C, a second vertical seal segment 64D disposed into the vertical slot segment 60D, and a third horizontal seal segment 64E disposed into the horizontal slot segment 60E. In an embodiment, the intersegment seals 64A and 64B may be coupled to one another, such as by tack welding 68, and the intersegment seals 64D and 64E may be coupled to one another, such as by tack welding 68, to prevent shifting of the seals within the seal slot 60. In an alternate embodiment, including a nozzle embodiment, the vertical seals 64B, 64D would not be coupled to the horizontal seal 64A, 64E. It is understood that according to various embodiments, the intersegment seals 64A, 64B, 64C, 64D, 64E may include any type of planar seal, such as a standard spline seal, solid seal, laminate seal, shaped seal (e.g. dog-bone), or the like, that is formed of a metal or metal alloy material. In an embodiment, the intersegment seals 64A, 64B, 64C, 64D, 64E are formed of a nickel alloy. In an embodiment, the intersegment seals 64A, 64B, 64C, 64D, 64E may be formed of a plurality of individual layers (e.g. laminate seal) that are only partially coupled to one another, thereby allowing for flexibility of the intersegment seal 64 (e.g., torsional movement).

The overhanging seal assembly 62 further includes an overhanging positioner shim seal 66, as best illustrated in FIG. 5. More particularly, a first overhanging positioner shim seal 66A is disposed on an exterior side 72 of each of the seal slot segments 60A and 60B and a second overhanging positioner shim seal 66B is disposed on an exterior side 72 of each of the seal slot segments 60D and 60E. The intersegment seals 64A, 64B, 64D and 64E are disposed on an interior side 74 of the seal slot segments 60A, 60B, 60D and 60E. In an embodiment, the first overhanging positioner shim seal 66A and the intersegment seal 64B may be connected to one another, such as by a tack welding 69, and the second overhanging positioner shim seal 66B and the intersegment seal 64D may be coupled to one another, such as by tack welding 69, to prevent shifting of the seals within the seal slot 60. In this particular embodiment, the first overhanging positioner shim seal 66A is not coupled to the intersegment seal 64A and the second overhanging positioner shim seal 66B is not coupled to the intersegment seal 64E. In another embodiment, the first overhanging positioner shim seal 66A may further be coupled to the intersegment seal 64A, such as by a tack welding, generally similar to tack welding 69, and the second overhanging positioner shim seal 66B may further be coupled to the intersegment seal 64E, such as by tack welding, generally similar to tack welding 69, to prevent shifting of the seals within the seal slot 60.

As illustrated, each of the overhanging positioner shim seals 66A and 66B includes an extended or overhanging portion 70 positioned on an interior side 74 of the seal slot segment 60C, to act as a position constrainer. More particularly, the extended or overhanging portion 70 provides and maintains positioning of the vertical intersegment seals 64B and 64D, relative to the horizontal intersegment seal 64C. The extended portion 70 of each of the overhanging positioner shim seals 66A and 66B prevents the vertical intersegment seals 64B and 64D from shifting downward, or toward the horizontal intersegment seal 64C, while reducing the number of parts count typically encountered in seal assembly design. The extended portion of each of the first overhanging positioner shim seal 66A and the second overhanging positioner shim seal 66B are adapted to move independently of the adjacent horizontal intersegment seal 64C. As previously described, CMC shrouds, such as shroud 54, have lower CTE compared to the intersegment seals 64A, 64B, 64C, 64D, 64E. Thus, the intersegment seals 64A, 64B, 64C, 64D, 64E are designed shorter to account for the CTE mismatch. The extended portion 70 of each of the overhanging positioner shim seals 66A and 66B prevents the vertical intersegment seals 64B and 64D from shifting down/falling and thus the lower horizontal intersegment seal 64C from crushing the vertical intersegment seals 64B and 64D while under-going thermal expansion.

In this disclosed overhanging seal assembly design, the top horizontal intersegment seals 64A and 64E are further coupled to the respective vertical intersegment seal 64B and 64D by the overhanging positioner shim seals 66A and 66B. The overhanging positioner shim seals 66A and 66B may provide sealing to minimize, if not eliminate, any corner leakage between the intersegment seals 64A, 64B, 64C, 64D, 64E at a plurality of corner regions 65. In addition, if the tack welds 68 fail after multiple cycles, the overhanging feature, and more particularly the extended portion 70, in each of the overhanging positioner shim seals 66A and 66B, would prevent the vertical intersegment seals 64B and 64D from shifting/dropping down toward the horizontal intersegment seal 64C.

Referring now to FIGS. 6 and 7, illustrated in schematic cross-section is an enlargement of a portion of the overhanging seal assembly 62 of FIG. 5 and a schematic cross-section of the overhanging seal assembly of FIG. 5, taken through line 7-7 of FIG. 5, in relation to the first arcuate component 52 and the second arcuate component 57. As best illustrated in FIGS. 6 and 7, in some particular embodiments, the vertical intersegment seals 64B and 64D have a length "X" of 15 millimeters to approximately 25 millimeters. In a preferred embodiment, the vertical intersegment seals 64B and 64D have a length "X" of approximately 15.8 millimeters (0.623 inches). In some particular embodiments, the intersegment seals 64 and the overhanging positioner shim seals 66A and 66B have a width "Y" of approximately 15 millimeters to approximately 25 millimeters. In a preferred embodiment, the intersegment seals 64 and the overhanging positioner shim seals 66A and 66B have a width "Y" of approximately 15.24 millimeters (0.6 inches). In some particular embodiments, the intersegment seals 64 have a thickness "Z" of approximately 0.6 millimeters to approximately 2.54 millimeters. In a preferred embodiment, the intersegment seals 64 have a thickness "Z" of approximately 0.754 millimeters.

In some particular embodiments, the overhanging positioner shim seals 66A and 66B have a thickness "T" of approximately 0.1 millimeters to approximately 1.3 millimeters. In a preferred embodiment, the overhanging positioner shim seals 66A and 66B have a thickness "T" of approximately 0.254 millimeters (0.01 inches/10 mils). In some particular embodiments, the extended portion 70 of each of the overhanging positioner shim seals 66A and 66B has a length "$L_E$" of approximately 10 millimeters to approximately 15 millimeters. In a preferred embodiment, the extended portion 70 of each of the overhanging positioner shim seals 66A and 66B has a length "$L_E$" of approximately 12.4 millimeters (0.489 inches). In some particular embodiments, the overhanging positioner shim seals 66A and 66B have a radius "$R_C$" of approximately 0.25 millimeters to approximately 1.0 millimeters. In a preferred embodiment, the overhanging positioner shim seals 66A and 66B have a radius "$R_C$" of approximately 0.635 millimeters (0.025 inches). In an embodiment, the overhanging positioner shim seals 66 have a width and overall length substantially equivalent to the width and overall length of the intersegment seal 64.

Referring still to FIG. 7, illustrated is a cross-section taken through line 7-7 of FIG. 5 showing an overhanging seal assembly 62 disposed into the seal slot 60 on the first arcuate component 52 and an adjacent slot 61 on the second arcuate component 57. Similar to slot 60, the seal slot 61 may be formed of multiple slot portions formed at an angle in relation to each other and connected or intersecting to one another. Each seal slot 60, 61 includes a plurality of substantially axial surfaces 56 and a plurality of radially facing surfaces 58 extending from the end of the substantially axial surfaces 56 as shown in relation to slot 60. An intersegmental gap 59 is left between the first arcuate component 52 and the second arcuate component 57. Illustrated are the intersegment seals 64A, 64B and 64C and the overhanging positioner shim seals 66A disposed within the intersegment gap 59 and seal slots 60 and 61. Alternate configurations and geometries of the seal slots 60, 61, including alternate seal slot geometry intersections, are anticipated by this disclosure.

In some cases, as shown in FIG. 5, the intersegment seals 64 include the plurality of segments 64A, 64B, 64C, 64D and 64E where each segment is disposed in one of the multiples slot segments 60A, 60B, 60C, 60D, 60E. It is anticipated that the intersegment seal 64 may be comprised of any number of segments, and that the five segment seal and cooperating slots of FIG. 5 are merely for illustrative purposes. Each segment 64A, 64B, 64C, 64D and 64E of the intersegment seal 64 may correspond with a distinct surface of the seal slot 60 (e.g., segment 64B corresponds with a first radially facing surface 54A of the seal slot segment 60B, segment 64C corresponds with axial surface 54B of the seal slot segment 60C and segment 64D corresponds with a second radially facing surface 54C of the seal slot segment 60D, etc.).

According to an embodiment, the overhanging positioner shim seal 66 (including segments 66A and 66B) and the intersegment seal 64 (including segments 64A, 64B, 64C, 66D and 64E) are adapted to move substantially independently of one another. In another embodiment, the overhanging positioner shim seal 66 (including segments 66A and 66B) and the intersegment seals segments 64A, 64B, 66D and 64E are tack welded as previously described, but adapted to move substantially independently from the intersegment seals segment 64C. In an embodiment, the extended portion 70 of each of the first overhanging positioner shim seal 66A and the second overhanging positioner shim seal 66B are adapted to move independently of the adjacent horizontal intersegment seal 64C.

The arrangement as disclosed provides a compact, relatively simple seal design that can be at least partially pre-assembled to aid in engine assembly (e.g., numerous seal pieces of the overhanging seal assembly 62 may be held together with shrink-wrap, epoxy, wax, or a similar binding material that burns away during engine operation). In alternate embodiments, the seal is assembled in the engine piece-by- piece (i.e. utilizing no binding materials) and may not include any pre-assembly.

In an embodiment, an important aspect of the design implementation of the overhanging seal assembly 62 is to solve the issue of CTE mismatch between the metal/metal-alloy seals and ceramic matrix composite (CMC) AGP heat transfer designed components, such as by preventing shifting of the vertically disposed seals within the seal slots. In addition, another important aspect of the design implementation of the overhanging seal assembly 62 is to minimize leakage at corners of seals slots in nozzles and shrouds.

FIG. 10 is a flow diagram illustrating a method 80 of forming an overhanging seal assembly in a gas turbine that utilizes AGP heat transfer designed components according to the various Figures. The method can include the following processes: Process P1, indicated at 82, includes forming an overhanging seal assembly (e.g., overhanging seal assembly 62), the forming including providing an overhanging positioner shim seal 66 (e.g., segments 66A, and 66B) and an intersegment seal 64 (e.g., segments 64A, 64B, 64C, 64D, and 64E) (FIG. 5). The overhanging positioner shim seals 66A and 66B including extended portions 70. Process P2, indicated at 84, includes applying the overhanging seal assembly 62 (e.g., the overhanging positioner shim seal 66 and the intersegment seal 64) to a turbine (e.g., gas turbine 10, FIG. 1), where applying includes inserting the overhanging seal assembly 62 in a seal slot 60 such that the intersegment seal 64 is on the interior side 74 of the seal slot 60 and wherein the overhanging positioner shim seal 66 is on the exterior side 72 of the seal slot 60. In an embodiment, the overhanging seal assembly (e.g., overhanging seal assembly 62) is disposed adjacent to the axial surfaces 56 and extends over the radially facing surfaces 58 of the seal slot 60. The overhanging positioner shim seal 66 is disposed to overlap portions of the intersegment seal 64, with extended portions 70 of the overhanging positioner shim seal 66 positioned on an interior side 74 of the seal slot 60 to prevent shifting of the vertically disposed seal segments 64B and 64D in a downward manner.

It is understood that in the flow diagram shown and described herein, other processes may be performed while not being shown, and the order of processes can be rearranged according to various embodiments. Additionally, intermediate processes may be performed between one or more described processes. The flow of processes shown and described herein is not to be construed as limiting of the various embodiments.

Accordingly, disclosed herein is an overhanging seal assembly that addresses the CTE mismatch between metal/metal-alloy seals and ceramic matrix composite (CMC) AGP heat transfer designed components. The overhanging seal assembly additionally provides for more effective sealing of inter-segment leakage at seal slot corners, while maintaining flexibility of the seal to accommodate manufacturing and assembly tolerances. In addition, the disclosed overhanging seal assembly is easy to assemble, prevents vertically disposed seals from shifting if tack welds fail, reduces the number of part count, and provides for an overall crush resistant seal system.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An overhanging seal assembly to seal a gas turbine hot gas path flow in a gas turbine, the overhanging seal assembly comprising:

an intersegment seal including a plurality of seal segments defining two vertical seal segments and a plurality of horizontal seal segments, the intersegment seal disposed in a seal slot, the seal slot comprising an interior side facing a high pressure fluid flow and an exterior side facing a low pressure fluid flow; and a first overhanging positioner shim seal and a second overhanging positioner shim seal, each overhanging positioner shim seal including a main portion and an extended portion, each of the main portions of the first and second overhanging positioner shim seals disposed in the seal slot between the exterior side of the seal slot facing the low pressure fluid flow and one of the two vertical seal segments, each of the extended portions of the first and second overhanging positioner shim seals disposed in the seal slot between the interior side of the seal slot facing the high pressure fluid flow and one of the plurality of horizontal seal segments to provide position constrainment of a respective vertical seal segment of the two vertical seal segments.

2. The overhanging seal assembly of claim 1, wherein the plurality of seal segments defining the two vertical seal segments comprise a first vertical seal segment and a second vertical seal segment, and wherein the plurality of horizontal seal segments comprise a first horizontal seal segment, a second horizontal seal segment, and a third horizontal seal segment, wherein the first vertical seal segment is disposed in the seal slot adjacent the first horizontal seal segment, the second horizontal seal segment is disposed in the seal slot adjacent the first vertical seal segment, the second vertical seal segment is disposed in the seal slot adjacent the second horizontal seal segment and the third horizontal seal segment is disposed in the seal slot adjacent the second vertical seal segment, the plurality of seal segments defining one or more corner regions.

3. The overhanging seal assembly of claim 2, wherein the first and second vertical seal segments are disposed on the interior side of the seal slot, the first and third horizontal seal segments are disposed on the interior side of the seal slot and the second horizontal seal segment is disposed on the exterior side of the seal slot.

4. The overhanging seal assembly of claim 3, wherein the first overhanging positioner shim seal is disposed in the seal slot on the exterior side of the seal slot adjacent the first horizontal seal segment, on the exterior side of the seal slot adjacent the first vertical seal segment, and on the interior side of the seal slot adjacent the second horizontal seal segment, and the second overhanging positioner shim seal is disposed in the seal slot on the exterior side of the seal slot adjacent the third horizontal seal segment, on the exterior side of the seal slot adjacent the second vertical seal segment, and on the interior side of the seal slot adjacent the second horizontal seal segment.

5. The overhanging seal assembly of claim 2, wherein the first overhanging positioner shim seal is coupled to the first vertical seal segment and the second overhanging positioner shim seal is coupled to the second vertical seal segment.

6. The overhanging seal assembly of claim 1, wherein the extended portion of each of the first overhanging positioner shim seal and the second overhanging positioner shim seal are disposed relative to one of the two vertical seal segments to constrain shifting to maintain positioning of the two vertical seal segments within the seal slot.

7. The overhanging seal assembly of claim 1, wherein the intersegment seal is formed of a metal material.

8. The overhanging seal assembly of claim 1, wherein the intersegment seal is a laminate seal.

9. The overhanging seal assembly of claim 1, wherein the first overhanging positioner shim seal and the second overhanging positioner shim seal have a thickness of 0.1 millimeters to 1.3 millimeters.

10. A gas turbine comprising:

a first arcuate component adjacent to a second arcuate component, each arcuate component comprised of a ceramic matrix composite (CMC) and including a seal slot defined by one or more seal slot segments, located in an end face, the seal slot having a plurality of axial surfaces and one or more radially facing surfaces extending from opposite ends of the axial surfaces, the seal slot comprising an interior side facing a high pressure fluid flow and an exterior side facing a low pressure fluid flow; and an overhanging seal assembly disposed in the seal slot of the first arcuate component and the seal slot of the second arcuate component, the overhanging seal assembly comprising:

an intersegment seal including a plurality of seal segments defining two vertical seal segments and a plurality of horizontal seal segments; and a first overhanging positioner shim seal and a second overhanging positioner shim seal, each overhanging positioner shim seal including a main portion and an extended portion, the main portion of the first overhanging positioner shim seal disposed in the seal slot between the exterior side of the seal slot and one of the two vertical seal segments, the main portion of the second overhanging positioner shim seal disposed in the seal slot between the exterior side of the seal slot and the other one of the two vertical seal segments, the extended portion of each of the first and second overhanging positioner shim seals disposed in the seal slot between the interior side of the seal slot and one of the plurality of horizontal seal segments and in a manner to provide position constrainment of the two vertical seal segments.

11. The gas turbine of claim 10, wherein the first arcuate component and the second arcuate component are one of turbine engine shrouds or turbine engine nozzles.

12. The gas turbine of claim 10, wherein the intersegment seal is formed of a metal material.

13. The gas turbine of claim 10, wherein the intersegment seal is a laminate seal.

14. The gas turbine of claim 10, wherein the main portion of the first overhanging positioner shim seal is coupled to an adjacent one of the two vertical seal segments and the main portion of the second overhanging positioner shim seal is coupled to another of the adjacent two vertical seal segments.

15. The gas turbine of claim 10, wherein the extended portion of each of the first overhanging positioner shim seal and the second overhanging positioner shim seal are adapted to move independently of an adjacent horizontal intersegment seal.

16. The gas turbine of claim 10, wherein the first overhanging positioner shim seal and the second overhanging positioner shim seal have a thickness of 0.1 millimeters to 1.3 millimeters.

17. A method of assembling a seal in a turbine, the method comprising:

forming an overhanging seal assembly, the forming including:

providing an intersegment seal including a plurality of seal segments defining two vertical seal segments and a plurality of horizontal seal segments; and providing a first overhanging positioner shim seal and a second overhanging positioner shim seal, each overhanging positioner shim seal including a main portion and an extended portion;

applying the overhanging seal assembly to the turbine, the turbine having:

a first arcuate component disposed adjacent to a second arcuate component, each arcuate component including a seal slot located in an end face and having a plurality of axial surfaces and radially facing surfaces extending from opposite ends of the plurality of axial surfaces, the seal slot comprising an interior side facing a high pressure fluid flow and an exterior side facing a low pressure fluid flow;

the applying including inserting the overhanging seal assembly in the seal slot of the first arcuate component and the second arcuate component such that the intersegment seal is disposed in the seal slot on each arcuate component and extending over the plurality of axial surfaces and the radially facing surfaces of the seal slots and the main portion of each of the first overhanging positioner shim seal and the second overhanging positioner shim seal disposed in the seal slots between the exterior side of each of the seal slots and one of the two vertical seal segments, each of the extended portions of the first and second overhanging positioner shim seals disposed in the seal slot between the interior side of the seal slot and one of the plurality of horizontal seal segments to provide position constrainment of a respective vertical seal segment of the two vertical seal segments.

18. The method of claim 17, wherein the intersegment seal is a laminate seal.

19. The method of claim 17, wherein the first arcuate component and the second arcuate component are one of turbine engine shrouds formed of a ceramic matrix composite or turbine engine nozzles formed of a ceramic matrix composite, and wherein the intersegment seal is formed of a metal material.

* * * * *